United States Patent [19]

Shoemaker

[11] 4,314,408

[45] Feb. 9, 1982

[54] COMBINATION DRAFTING INSTRUMENT INCLUDING ROTATABLE SCALES, COMPASS ASSEMBLY AND STRAIGHT EDGE MAGNIFIER

[76] Inventor: Dwight E. Shoemaker, 9234 Chatwood Dr., Houston, Tex. 77078

[21] Appl. No.: 97,128

[22] Filed: Nov. 26, 1979

[51] Int. Cl.[3] ..... B43L 7/08

[52] U.S. Cl. ..... 33/494; 33/488; 33/27 C; 33/158

[58] Field of Search ..... 33/488, 494, 27 C, 158

[56] References Cited

U.S. PATENT DOCUMENTS

| | | | |
|---|---|---|---|
| 713,097 | 11/1902 | Heydrick | 33/494 X |
| 2,124,550 | 7/1938 | Evans | 33/494 X |
| 2,178,293 | 10/1939 | Wogeck | 33/158 |
| 2,355,585 | 8/1944 | Halstead . | |
| 2,468,191 | 4/1949 | Fullilove . | |
| 2,651,235 | 9/1953 | Barrows . | |
| 2,736,097 | 2/1956 | Coleman . | |
| 2,832,141 | 4/1958 | Taylor . | |
| 2,954,611 | 10/1960 | Wiskoff | 33/494 X |
| 3,156,981 | 11/1964 | Sutton . | |
| 3,524,258 | 8/1970 | Novak . | |
| 3,738,009 | 12/1973 | Kuwada . | |
| 4,051,599 | 10/1977 | Sinkovec . | |

*Primary Examiner*—Charles E. Phillips
*Attorney, Agent, or Firm*—Arnold, White & Durkee

[57] ABSTRACT

A combination drafting instrument including a beam compass, a magnifying glass, a protractor, a proportional divider, an architectural scale, an engineering scale and other scales in a single self-contained package in order to perform most ordinary drafting procedures.

7 Claims, 18 Drawing Figures

3
3
5
5
8
8
21
21
24
24
34
37
47
47
59
22
30
31
32
33
38
1/4
3/16
1/8
3/32
10
20
30
23
35
39
40
42
43
44
45
46
48
49
50
51
52
53
54
55
56
57
58
61
74
84
27
28
29

COMBINATION DRAFTING INSTRUMENT INCLUDING ROTATABLE SCALES, COMPASS ASSEMBLY AND STRAIGHT EDGE MAGNIFIER

BACKGROUND OF THE INVENTION

This invention relates generally to a novel drafting instrument. More particularly, this invention concerns a drafting instrument which combines a graphics tube having a multiplicity of engineering, architectural and other linear scales being rotatably mounted in an outer tubular body with a straightedge magnifier and a compass assembly.

In the past, normal drafting techniques have required several types of tools. It has been common for a draftsman to be required to purchase separately a beam compass, a magnifying glass, a protractor, a proportional divider, an architectural scale, an engineering scale and other scales in order to perform most ordinary drafting procedures. Not only is the purchase of all of the above instruments relatively expensive, but the utilization of so many instruments has necessitated frequent searching around the working area for the proper instrument. The invention disclosed herein combines all of the above into a single self-contained package.

The Prior Art

A typical beam compass with plural scales is shown in U.S. Pat. No. 3,156,981, dated Nov. 17, 1964, issued to D. A. Sutton. Sutton discloses a stationary support 48 which grips a reference pin, and a slidable support 100 which grips a graphite lead. A plurality of scales are presented on the surface of the bar-14 beneath transparent slide 55. Sutton also discloses a nob 47 which stands up from the top edge of the scale beam.

In order to scribe a circle or large arc with the device disclosed by Sutton, the draftsman's grip upon the support 100 often must be changed. Therefore, if a draftsman looks away from the scale, he must then be careful to locate the correct scale upon the instrument when he glances back at the scale. Because of this fact, the draftsman must concentrate upon distinguishing the correct scale, and the work, consequently, can become very tedious and tiring to the eyes.

Other typical prior art devices are disclosed in U.S. Pat. No. 2,832,141, to Taylor; U.S. Pat. No. 3,738,009, to Cuwada; and U.S. Pat. No. 4,051,599, to Sinkovec.

U.S. Pat. No. 3,524,258, dated Aug. 18, 1970, issued to W. D. Novak, discloses a slide compass. The Novak device has a flat slide bar 55 having a flat marking foot depending from one end and slidable within the transverse slideway. The Novak device has an indicia bearing scale secured to the slide.

Other typical devices are disclosed in U.S. Pat. No. 2,651,235, issued to Barrows; and U.S. Pat. No. 2,736,097, issued to Colemen, Jr.

U.S. Pat. No. 2,178,293, dated Oct. 31, 1939, issued to W. Wogeck, discloses a measuring device or caliper having a tubular body 1, an end support 2 and a slidable support 3. The Wogeck device is limited in its use to making measurements between points. Wogeck does not suggest providing plural scales along the outer surface of the tubular body 1.

U.S. Pat. No. 2,355,585, dated Aug. 8, 1944, issued to L. R. Halstead, discloses a beam compass of a conventional type. The Halstead device has a rod shaped body or beam 11 along which a graphite carrying member and a pin carrying member is slidably supported. The Halstead device does not suggest the provision of scales along the surface of the beam 13.

U.S. Pat. No. 2,468,191, dated Apr. 26, 1949, issued to D. L. Fullilove, discloses a multiscale rule. The Fullilove device discloses a rule body 2 having a hexagonal prism 52 which is rotatably mounted therein. A turning knob 54 is attached to the prism member 52 and has its head knurled to permit conventional turning of the prism member 52 about its longitudinal axis.

In the past, drafting work has been very tedious and tiring to the eyes and has required a number of physical motions and procedures because numerous tools were required in order to perform most such drafting procedures. Frequent searching for the proper instruments around the working area has been required as a draftsman reaches a step in the procedure which requires a different tool. Thus, a need has existed for a single, inexpensive drafting tool which is accurate and which provides the necessary instrumentation to perform most drafting procedures without the need for additional tools.

While the previously discussed prior art arrangements have exhibited at least a degree of utility in providing drafting instruments which are useful in a limited number of applications, room for significant improvement remains. The prior art arrangements have failed to disclosed a single tool which could replace the need for separately purchasing an architect's scale, an engineering scale, a beam compass, a magnifier, a protractor, a proportional divider, an "80" scale, a millimeter scale, a plurality of map scales, and which is adaptable to a large number of other desired scales by merely changing a readily replaceable tube.

The problem enumerated in the foregoing are not intended to be exhaustive, but rather are among many which tend to impair the effectiveness of previously known drafting instruments. Other noteworthy problems may also exist; however, those presented above should be sufficient to demonstrate that drafting instruments appearing in the art have not seen altogether satisfactory.

SUMMARY OF A PREFERRED EMBODIMENT OF THE INVENTION

While prior art arrangements have exhibited at least a degree of utility in providing several individual and expensive drafting instruments for accomplishing most standard drafting procedures, room for significant improvement remains. It is, therefore, a general feature of the present invention to provide a novel drafting instrument capable of replacing the need for numerous separate instruments heretofore required to perform most normal drafting procedures and which minimizes or reduces the problems of the type previously noted.

It is a more particular feature of the present invention to provide a single drafting instrument which performs the functions of several pieces of equipment and which can be manufactured less expensively. A feature of the present drafting instrument resides in the provision of an instrument the scales of which are easier to read and less tiring to the eyes. Only one scale at a time may be displayed, thus avoiding the more tiring concentration required when several scales are displayed at once, and the confusion and error that often results when a draftsman fails to concentrate carefully to insure that he takes each reading from the correct scale. A feature of the present invention involves the provision of a means for quickly and accurately locating or selecting scales measurement points.

A further feature resides in the provision of a drafting instrument that permits the selection of the appropriate scale and permits readings to be taken at a comfortable eye level without requiring the draftsman to maintain an uncomfortable position over the working surface. Moreover, the present invention includes a magnifier straightedge as a further feature that permits the magnification of a portion of the working surface when making a measurement. A corolary feature resides in the provision of an instrument that reduces eye strain and facilitates ease of measurement by magnifying images on the working surface or a sheet of drafting paper.

The present invention includes the feature of providing a plurality of scales, typically 20, on a single instrument, including both architect's and engineer's scales on a single instrument.

A still further feature resides in the practically unlimited number of scales permitted because the graphics tube is replaceable. A graphics tube with the desired scales may be substituted into the instrument to provide substantially any scale desired. Conversions between scales, for example English to metric, may be accomplished by rotation of the graphics tube. The present invention includes the feature of providing a means for operation as a proportional divider by rotating scales. A scale of a drawing may be determined quickly by placing the hairlines across a given dimension and rotating the graphics tube until that appropriate value appears on the cursor crosshair. A properly calibrated scale permits the invention to also be used as a protractor.

And finally, the present invention includes the feature of being convertible to form a lightweight beam compass. The compass feature of the present invention includes means for easily scribing a circle without a draftsman changing his grip upon the instrument.

A drafting instrument according to a presently preferred embodiment of the invention intended to substantially incorporate the foregoing features includes an outer tubular body having an elongated viewing slot to permit the display of a single scale from a graphics tube. A graphics tube is provided having a plurality of scales on its face and which is adapted to fit inside the outer tubular body. The graphics tube may be rotated to bring any scale into alignment with the viewing slot of the outer tubular body. A straightedge magnifier is provided to magnify images on the working surface, and the magnifier has a straight edge to facilitate drawing straight lines.

A cursor assembly slides along the outer tubular body and has upper and lower hairline means to permit accurate reading of measurements. The upper hairline means is alignable upon the scales of the graphics tube; and the lower hairline means is alignable upon the working surface.

A pivot pin assembly and a scribing implement assembly are provided, and may be removed from a normally stowed position inside the outer tubular body and used in combination with the graphics tube to form a compass. The pivot pin assembly and the scribing implement assembly are both adapted to securely seat within the ends of the graphics tube in the normally stowed position when the instrument is not being used as a compass, and to provide knobs to facilitate rotation of the graphics tube within the outer tubular body. The pivot pin assembly and the scribing implement assembly may both be removed from the ends of the graphics tube, the graphics tube withdrawn from the outer tubular body, and a compass may be formed by inserting the graphics tube into apertures in the pivot pin assembly and the scribing implement assembly.

Flex-band assemblies on the pivot pin assembly and the scribing implement assembly permit the pivot pin assembly and the scribing implement assembly to be inserted within the graphics tube, while also expanding sufficiently to permit the graphics tube to be inserted within apertures in the pivot pin assembly and the scribing implement assembly to form a compass.

Rotatable knobs on the pivot pin assembly and the scribing implement assembly facilitate drawing circles with the instrument in a comfortable manner when the compass configuration is employed without necessitating the draftsman's grip to be changed upon the instrument.

Appropriate scales upon the graphics tube assembly permit the instrument to be used as a protractor to measure angles in a manner described more fully below.

Examples of the more important features of this invention have thus been summarized rather broadly in order that the detailed description thereof that follows may be better understood, and in order that the contribution to the art may be better appreciated. The invention may be understood more fully from a consideration of the following detailed description taken in connection with the accompanying drawings forming a part of this specification, with the understanding, however, that the invention is not confined to a strict conformity with the showing of the drawings but may be changed or modified so long as such changes or modifications mark no material departure from the salient features of the invention as defined by the appended claims.

DETAILED DESCRIPTION OF A PREFERRED EMBODIMENT OF THE INVENTION

Figure 1:
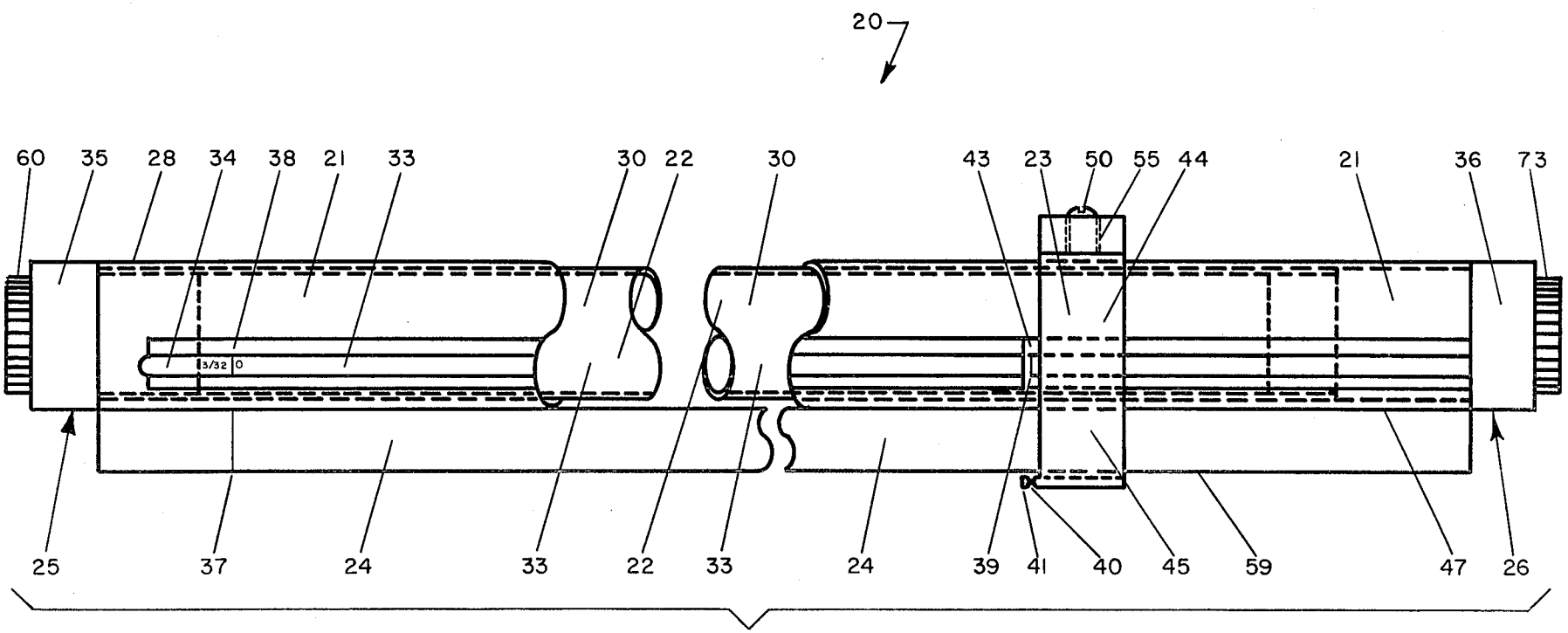
FIG. 1 depicts a fragmentary plan view of the drafting instrument showing the drafting instrument assembled with the pivot pin assembly and the scribing implement assembly stowed inside the graphics tube.

Referring now to the drawings, wherein identical reference numerals designate like or corresponding parts throughout the several views, and particularly referring to FIG. 1, there is shown a drafting instrument 20 incorporating the invention.

The drafting instrument 20 comprises an outer tubular body 21, a graphics tube 22, a cursor assembly 23, a straightedge magnifier 24, a pivot pin assembly 25 and a marking implement or scribing implement assembly 26, as illustrated in FIG. 1.

Figures 2, 3, 4, 5, 6, 7, 8, 9:
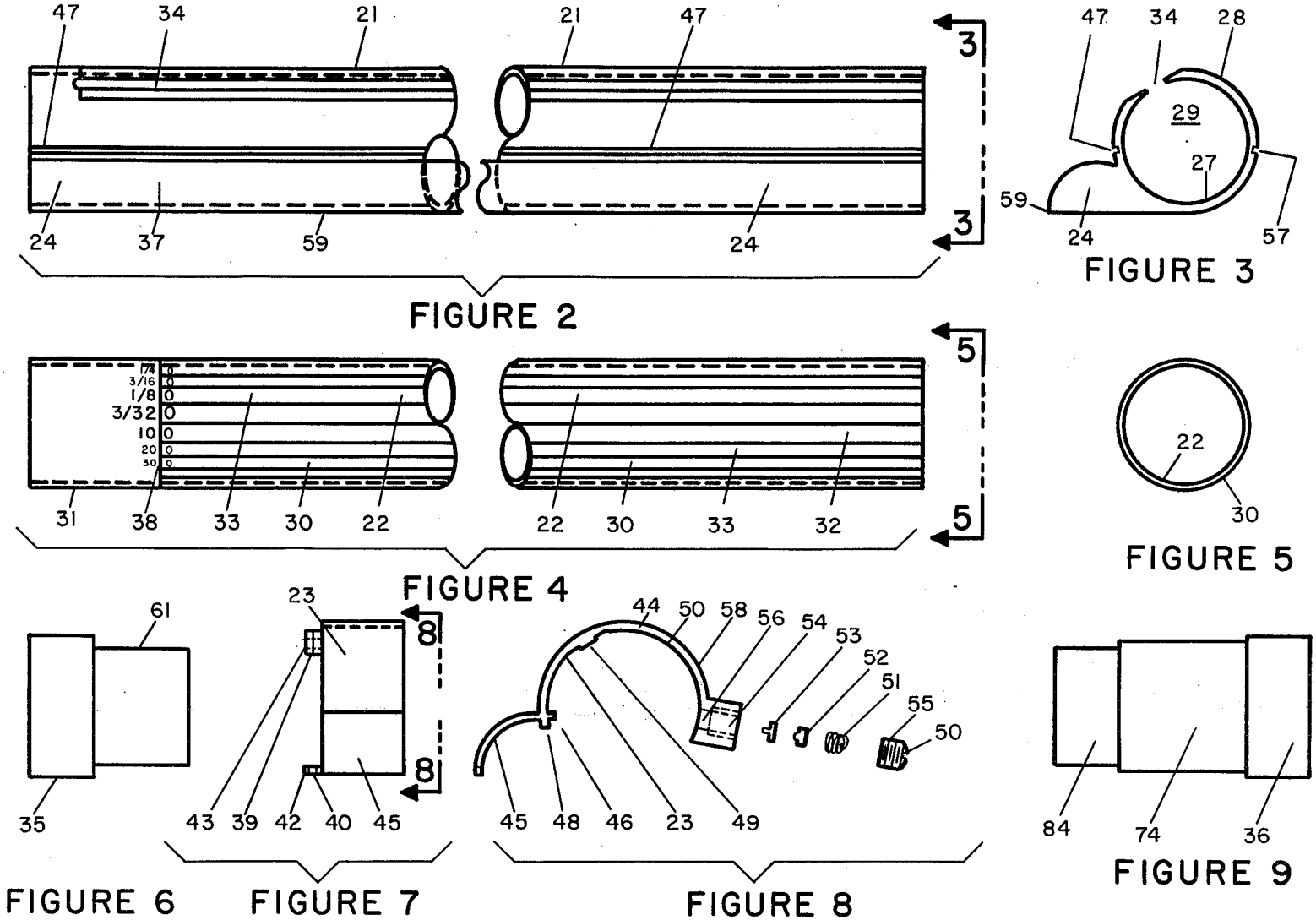
FIG. 2 illustrates a fragmentary elevation view showing the outer tubular body.
FIG. 3 shows a right side view of the outer tubular body.
FIG. 4 depicts a fragmentary elevation view illustrating the graphics tube.
FIG. 5 illustrates a side view of the graphics tube.
FIG. 6 shows an elevation view of the first end portion with the first raised knob.
FIG. 7 shows an elevation view and illustrates the cursor assembly.
FIG. 8 shows a fragmentary side view of the cursor assembly.
FIG. 9 depicts an elevation view of the second end portion with the second raised knob.

The outer tubular body or cylinder 21 is cylindrically shaped, having a bore or graphics tube receiving chamber 29. The tubular body 21 forms a tube which is adapted to receive the graphics tube 22. The graphics tube 22 is adapted to be coaxially inserted into the tubular body 21. As best shown in FIG. 3, the longitudinal bore 29 extends preferably substantially the entire length of the body 21. The bore 29 forms an inner surface 27 and an outer surface 28. The inner surface 27 has a radius which is preferably just large enough to permit the graphics tube 22 to be inserted into the bore 29 and rotate without inhibition. It will be understood that the bore 29 need not extend the entire length of the tubular body 21. The tubular body 21 could be constructed to permit the graphics tube 22 to be inserted in only one end of the tubular body 21. In a preferred embodiment, the bore 29 extends completely through the tubular body 21 in order to permit the pivot pin assembly 25 and the scribing implement assembly 26 to be inserted into the ends of the tubular body 21, as will be explained more fully below. The graphics tube 22 maybe rotated by either the right hand or the left hand of a draftsman. The tubular body 21 provides support and a protective enclosure for the graphics tube 22.

Figure 18:
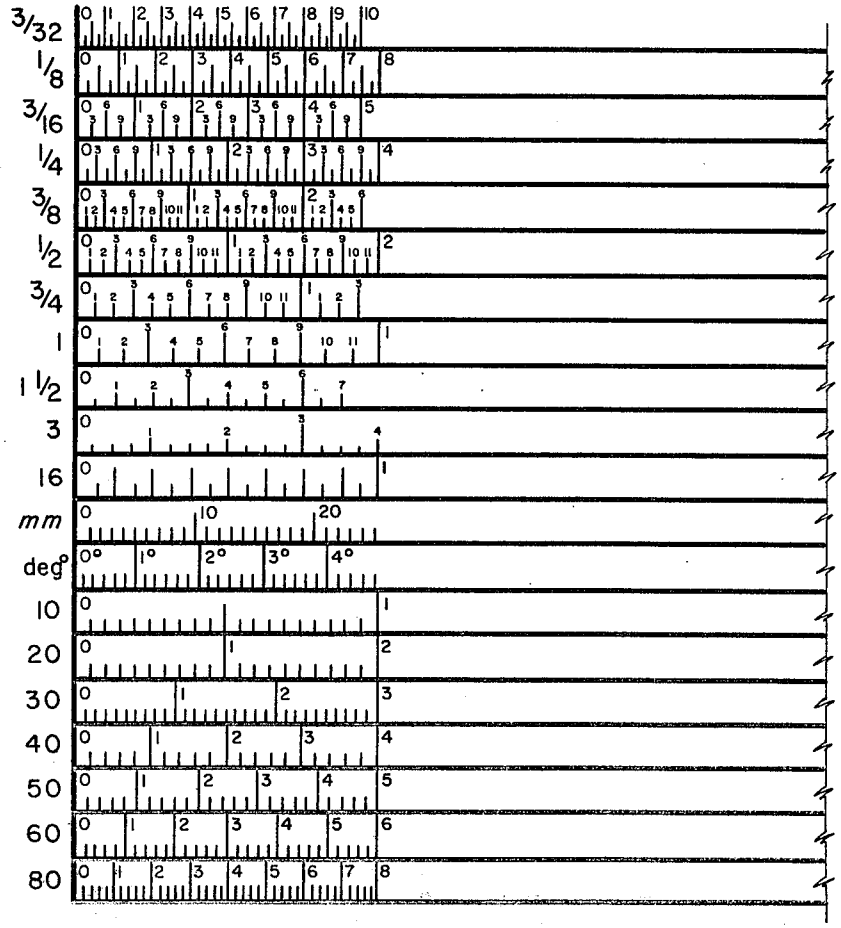
FIG. 18 illustrates scales to be used with the graphics tube.

In the present instance, as shown in FIG. 4, the graphics tube 22 has a face 30, a first end 31 and a second end 32. In the illustrated form, the graphics tube 22 has a plurality of architectural and engineering scales 33 upon the face 30 of the tube 22. Millimeter scales and protractor scales 33 may also be included, as desired. An example of useful scales is shown in FIG. 18. It will be understood that other scales in addition to architectural and engineering scales 33 may be placed upon the graphics tube 22. Preferably, the graphics tube 22 may have twenty scales 33 upon its face 30. It will be understood that numerous graphics tubes 22 may be substituted one for another to provide a multitude of different scales 33 for use in connection with the instrument 20, including metric conversion scales.

It is desirable to provide a means for displaying only one scale 33 at a time in order to reduce the eye strain and required concentration that the draftsman must maintain to insure that he does not take a reading from the wrong scale, particularly when the draftsman looks away from the instrument during the course of the measurement or series of measurements. In the present invention, this is essentially accomplished by an axially elongated viewing slot or aperture 34. In a preferred embodiment, the viewing slot 34 is adapted to permit the display of only one scale 33 at a time, although the graphics tube 22 may be rotated as explained more fully below to display any one of the scales 33 at a time. In the present instance, the viewing slot 34 communicates between the inner surface 27 and the outer surface 28 and extends longitudinally along the tubular body 21 substantially the entire length of the tubular body 21. As shown best in FIG. 2, the viewing slot 34 starts a relatively short distance from an end of the tubular body 21 and extends completely to the other end of the tubular body 21. Preferably, the viewing slot 34 is long enough to permit full display of the scales 33 upon the graphics tube 22. If the scales 33 do not extend all of the way to the second end 32 of the graphics tube 22, then the viewing slot 34 may stop short of extending completely to one end of the outer tubular body 21. The viewing slot 34 preferably exposes the entire length of the scales 33.

In operation, the graphics tube 22 may be inserted into the tubular body 21, as shown in FIG. 1, and the graphics tube 22 rotated to bring any desired scale 33 into alignment with the viewing slot 34. In this manner any of the scales 33 are viewable through the viewing slot 34 when the graphics tube 22 is thus rotated to bring the corresponding face 30 of the graphics tube 22 into alignment with the viewing slot 34.

As will be explained more fully below, the pivot pin assembly 25 and the scribing implement assembly 26 may be inserted into the ends of the graphics tube 22 and the tubular body 21 in order to hold the graphics tube 22 within the tubular body 21 and inhibit longitudinal movement of the graphics tube 22 within the tubular body 21. As shown in FIG. 1, the pivot pin assembly 25 has a first raised knob, upset portion or flange 35. Similarly, the scribing implement assembly 26 has a second raised knob, upset portion or flange 36. The first and second knobs 35 and 36 provide a convenient means for properly aligning the graphics tube 22 within the tubular body 21, means for rotating the graphics tube 22 within the tubular body 21, and means for grasping the assembly 25 or 26 when used as a compass.

It is oftentimes desirable to magnify small images upon the working surface, especially where accurate measurements are desired. It is desirable to have this magnification done automatically without requiring the draftsman to hold a separate magnifier in his hand. In the present instance, magnification is accomplished by the straightedge magnifier 24. The straightedge magnifier 24 is attached to the front part of the tubular body 21. The strain upon the draftsman's eyes is reduced by the instrument 20 because small, difficult-to-read images on a working surface or sheet of drafting paper (not shown) may be magnified by the straightedge magnifier 24. Accurate measurement is further facilitated by a fixed hairline register means 37. The fixed hairline register means 37, shown in FIG. 1, may be a thin straight line preferably placed upon the underside of the straightedge magnifier 24 and which is in corresponding alignment with initial or zero graduations 38 upon the scales 33. This arrangement avoids parallax problems. Thus, the fixed hairline register 37 provides a convenient indication of the initial or zero position 38 on the scales 33 which is superimposed upon a portion of the working surface or a sheet of drawing paper that is simultaneously magnified by the straightedge magnifier 24. The image of interest on the working surface is magnified; and this serves to facilitate measurements where the hairline register means 37 is used. The convenient magnification provided by the straightedge magnifier 24 serves to reduce the eye strain upon the draftsman.

Preferably, the straightedge magnifier 24 is constructed of transparent plastic and is fastened to the tubular body 21, which is preferably opaque. In practice, aluminum has proven to be a satisfactory material for the tubular body 21. Equivalent materials may include steel, plastic, polypropylene, transparent nylon, or a combination opaque material with a transparent panel molded therein.

Accurate measurement is further facilitated by the cursor assembly 23. The cursor assembly 23 has an upper hairline means or scale reading hairline means 39 and a lower hairline means or working surface hairline means 40. The lower hairline means 40 is in corresponding relationship to the upper hairline means 39 so that the distance between the lower hairline means 40 and the fixed hairline register means 37 can be read directly upon the appropriate scale 33 by reading a corresponding graduation appearing under the upper hairline means 39. In the present instance, the lower hairline means 40 is located in direct vertical correspondence with, or directly below, the upper hairline means 39. Preferably, the upper and lower hairline means 39 and 40 lie along the same line perpendicular to the scales 33. However, it will be understood that the lower hairline means 40 does not necessarily have to be located directly vertically below the upper hairline means 39. The scales 33 could be adjusted, if desired, to provide an appropriate reading upon the graduation aligned with the upper hairline means 39 even if the lower hairline means 40 were not directly below the upper hairline means 39.

In the embodiment illustrated in FIG. 1, the lower hairline means 40 may comprise a notch or detent in a protuberance or nib 41. Alternatively, as shown in FIG. 7, the lower hairline means 40 may comprise a thin line etched, drawn, or otherwise made upon a small projecting transparent finger 42, or a knife-edge embodiment may be used. In the illustrated embodiment, shown in FIG. 7, the finger 42 is generally rectangular in shape and connected to the cursor assembly 23. The upper hairline means 39 may comprise a similar transparent finger or projection 43 with an appropriate hairline upon it. If the nib 41, the finger 42 or the projection 43 have a significant thickness, then it is preferable to place the hairline upon the surface closest to the scales 33 or the working surface in order to avoid parallax problems. The finger 42 and the projection 43 may extend from either the left or the right side, or both, of the cursor 23.

The cursor assembly 23 is adapted to slide up and down the outer surface 28 of the tubular body 21. In a preferred embodiment, the cursor assembly 23 generally conforms to the shape of the outer tubular body 21 or generally registers upon the outer surface 28 of the tubular body 21 in order to inhibit radial movement of the cursor assembly 23 which might move the lower hairline means 40 out of alignment with the upper hairline means 39, or move the upper hairline means 39 out of alignment with the graduations upon the scales 33. As best shown in FIG. 8, the cursor assembly 23, according to a presently preferred embodiment, comprises a semicircular arc or tubular body cover 44 and an arcuate surface or magnifier cover 45, which are both adapted to generally conform to the shape of the outer surface 28 and the surface of the straightedge magnifier 24, respectively. Preferably, the magnifier cover surface 45 does not extend underneath the straightedge magnifier 24 in order to avoid interfering with the working surface when the cursor assembly 23 slides or is moved longitudinally upon the tubular body 21. It will be appreciated that the tubular body cover surface 44 fits upon the tubular body 21 in a generally coaxial relationship. The tubular body cover 44 may be shaped in the form of an arc which is greater than a semicircle, if desired. If shaped appropriately and fashioned out of resilient material, generally plastic, the cursor assembly 23 may be adapted to "snap on" the tubular body 21 and hold itself generally upon the outer tubular body 21. Preferably, the cursor assembly 23 may be placed upon the tubular body 21 by removing either the first or second raised knob 35 or 36 and sliding the cursor assembly 23 onto the end of the tubular body 21.

It is desirable to have the cursor assembly 23 register upon the tubular body 21 in a manner that permits it to slide up and down the length of the tubular body 21, yet which inhibits the cursor assembly 23 from rotating upon the tubular body 21. In the present instance, this is essentially accomplished by a guide shoe or finger 46, illustrated in FIG. 8. The guide shoe 46 generally fits within or registers within a guide groove, channel or longitudinal serration 47, best shown in FIG. 3. Guide shoe 46 thus fits into and slides along guide groove 47 and inhibits rotational movement of the cursor assembly 23 upon the tubular body 21.

Similarly, a compression guide 53 also fits within a compression guide groove 57 and similarly operates, in cooperation with the guide shoe 46 and the guide groove 47, to hold the cursor assembly 23 in proper alignment with the tubular body 21. The compression guide 53 is spring loaded to allow flexibility while the cursor 23 is being slid longitudinally along the tubular body 21, but "snaps" the cursor 23 into proper alignment when released. The detailed construction of the spring loaded compression guide 53 is described below.

If desired, a bearing surface 48 may be formed upon the end of the tubular body cover surface 44 as shown in FIG. 8 to aid in securely registering the cursor assembly 23 upon the outer surface 28 of the tubular body 21. In a preferred embodiment, the cursor assembly 23 also includes a boss or shoe 49 which protrudes from an inner surface 50 of the cursor assembly 23 and which is in positional agreement and confronting relation with the viewing slot 34. Thus, the boss 49 may engage the elongated viewing slot 34 and cooperates to register the cursor assembly 23 into the appropriate corresponding relationship with the outer tubular body 21.

It is sometimes desirable to be able to adjust the freedom of the cursor assembly 23 to slide upon the outer surface 28 of the tubular body 21. This feature of adjustibility permits the draftsman to adjust this aspect of the instrument 20 as desired. In the present instance, this is essentially accomplished by a set screw 50, a spring, flexible member or resilient member 51, a compression plunger 52 and the compression guide 53, as shown in FIG. 8. The compression guide 53, compression plunger 52, spring 51 and set screw 50 are adapted to fit within an adjustment chamber 54. Preferably the chamber 54 has helical threads (not shown) upon it which are adapted to engage corresponding threads 55. Thus, the compression guide 53, compression plunger 52, spring 51 and set screw 50 may be inserted in the order shown in FIG. 8 into the chamber 54 and tightened against the tubular body 21 by turning the set screw 50. An opening 56 communicates between the inner surface 50 and an outer surface 58 of the cursor assembly 23 in order to enable the compression guide 53 to engage the outer surface 28 of the tubular body 21 in the guide groove 47.

As best shown in FIG. 3, the tubular body 21 has the axially elongated compression guide groove or channel 57 formed in the outer surface 28. The compression guide groove 57 extends longitudinally substantially the entire length of the tubular body 21, in a preferred embodiment. The compression guide 53 is adapted to register within the compression guide groove 57 and thus hold the cursor assembly 23 into comforming relationship with the tubular body 21. The spring 51 tends to hold the compression guide 53 against the compression guide groove 57 in a manner that facilitates sliding the cursor assembly 23 along the tubular body 21. The compression plunger 52 may be omitted, if desired, but the compression plunger 52 provides a degree of "play" in the compression guide 53 and thus facilitates smooth operation and sliding of the cursor assembly 23.

Most normal drafting procedures require the use of a straight edge or an instrument adapted to facilitate the drawing of a straight line. In the present instance, this feature is substantially accomplished by the straightedge magnifier 24. The straightedge magnifier 24 has a straightedge 59. It will be understood by reference to FIG. 3. that the straight edge 59 is adapted to meet in positional agreement with a substantially planar working surface. Thus, a marking implement or scribing implement may be used to draw a straight line by drawing the implement along the straightedge 59 in accordance with standard drafting procedure.

Figure 12:
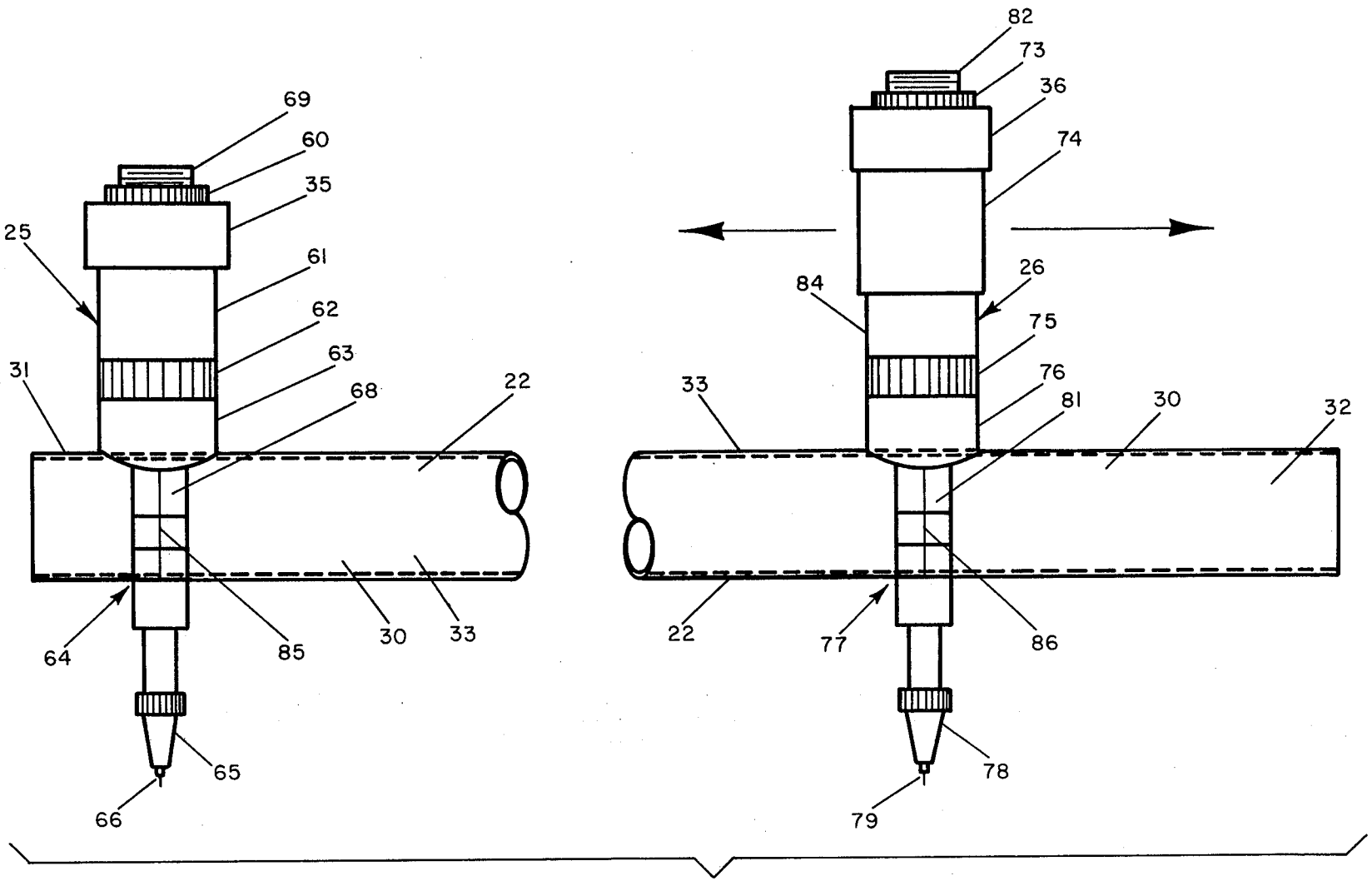
FIG. 12 shows a fragmentary elevation view of the pivot pin assembly, the graphics tube and the scribing implement assembly configured as a compass.

Many normal drafting procedures require the use of a compass or caliper. Thus, it is desirable to provide a single instrument 20 which is also adaptable to form a compass or caliper. As shown in FIG. 12, the instrument 20 may be configured as a compass or caliper substantially in accordance with the illustrated embodiment. The graphics tube 22 may be removed from the tubular body 21 and used in conjunction with the pivot pin assembly 25 and the scribing or marking implement assembly 26 to form a compass or a caliper.

Figures 10, 11:
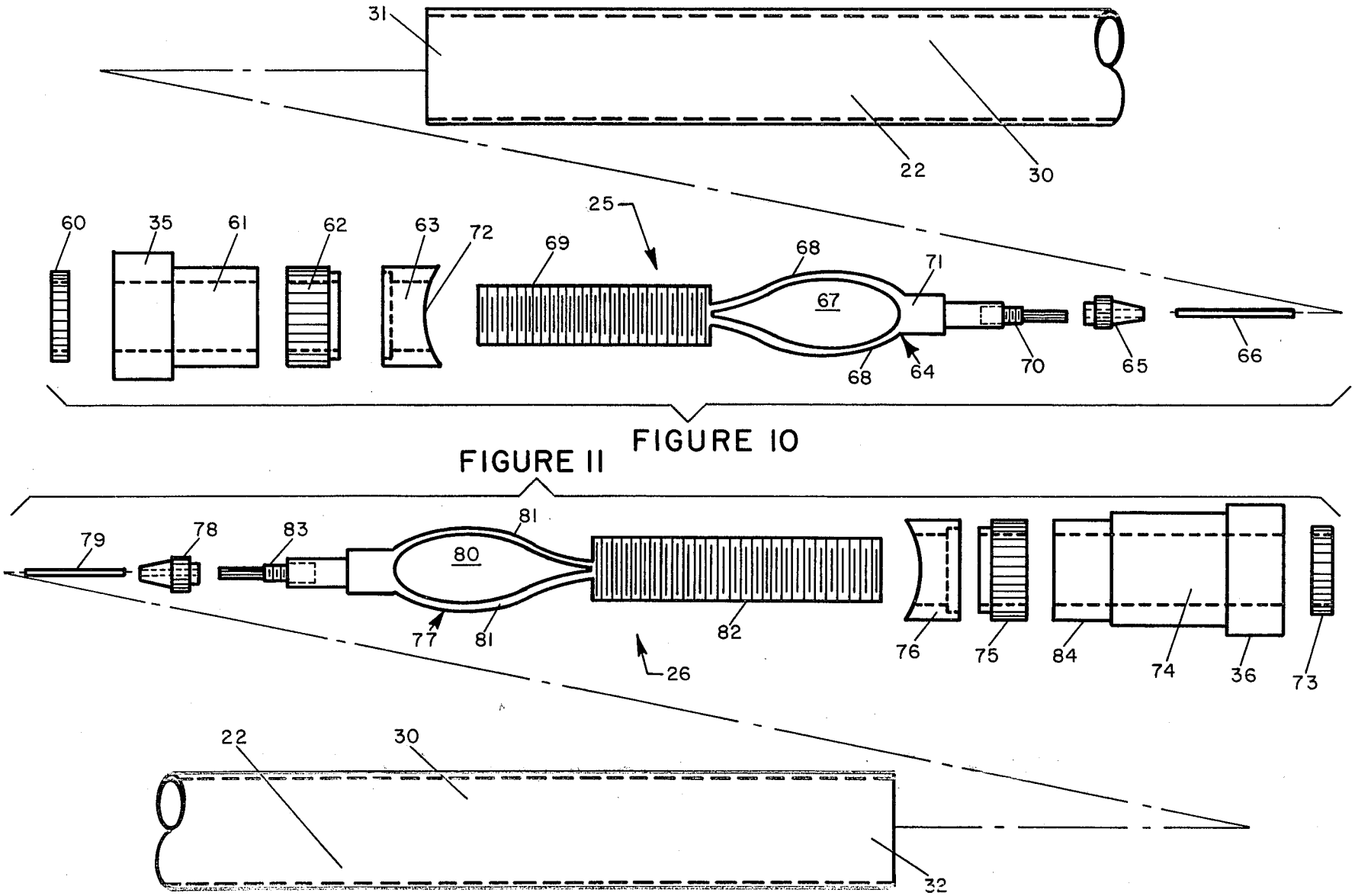
FIG. 10 illustrates a fragmentary elevation view of the pivot pin assembly and the graphics tube.
FIG. 11 depicts a fragmentary elevation view of the scribing implement assembly and the graphics tube.

As best shown in FIG. 10, the pivot pin assembly 25 comprises a first set nut 60, a first end portion 61, a first lock nut 62, a first saddle 63, a first flex-band assembly 64, a pin chuck 65 and a pin point 66. The pivot pin assembly 25 may be assembled as shown in FIG. 12. Referring to FIG. 10, the first flex-band assembly 64 has a first aperture 67 formed by flexible or resilient walls 68. The walls 68 are flexible to permit them to be compressed so that the pivot pin assembly 25 may be stowed or placed within the first end 31 of the graphics tube 22. The walls 68 are also resilient in order to permit sufficient expansion so that the graphics tube 22 may be inserted into the first aperture 67 to form a compass or caliper assembly as shown in FIG. 12. Although the first aperture 67 is shown in FIG. 10 as being generally oval in shape, when the walls 68 are expanded to permit insertion of the graphics tube 22, the walls 68 preferably expand to form a circular first apertures 67 which snuggly fits in corresponding relationship with the face 30 of the graphics tube 22.

The first flex-band assembly 64 further comprises a first threaded post 69 and a threaded pin chuck receiving post 70. In the illustrated embodiment of FIG. 10, the first threaded post 69 and the threaded pin chuck receiving post 70 are securely joined to a center portion 71 of the first flex-band assembly 64. Preferably, the flex-band assembly 64 is fashioned into a single object comprising a one piece construction.

The first saddle 63 is adapted to coaxially fit upon the first threaded post 69. The first lock nut 62 has a bore extending through it having threads corresponding to the threads upon the first threaded post 69 and is adapted to screw down upon the first threaded post 69 to compress the walls against the graphic tube 22 for locking in place during use. The first end portion 61 is adapted to coaxially fit upon the first threaded post 69 of the first flex-band assembly 64. The first set nut 60 has a bore extending through it with threads corresponding to the threads upon the first threaded post 69 and is adapted to screw down upon the first threaded post 69. The first set nut 60 may alternatively comprise a snap-on fastener of a conventional type. Thus, in the illustrated embodiment, the first saddle 63, the first lock nut 62, the first end portion 61 and the first set nut 60 may be assembled upon the first threaded post 69 as shown in FIG. 12. The first saddle 63 may be generally shaped in the form of a circular arc or arcuate surface 72 which is adapted to positionally agree with the curved face 30 of the graphics tube 22.

Figure 17:
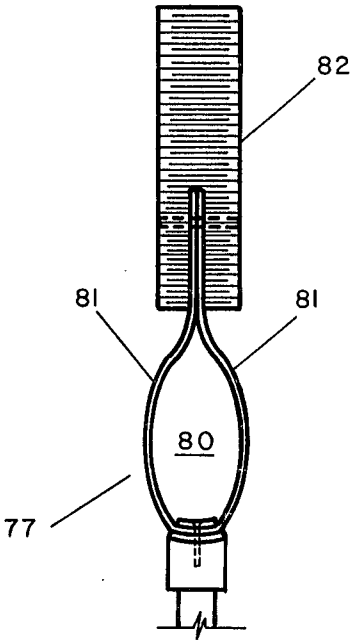
FIG. 17 shows an alternative embodiment of the flex band assembly.

An alternative construction of the flex-band assemblies 64 and 77 has given satisfactory results in practice, and is shown in FIG. 17. The resilient walls 81 are formed from a single, generally rectangular piece of plastic which is sufficiently flexible to be looped such that the two ends are joined, as shown in FIG. 17. The ends are securely joined to the threaded post 82. The saddle 76 may be tightened down on the piece of plastic to conform the size of the aperture 80 to the size of the graphics tube 22.

This alternative construction as shown in FIG. 17 permits the flex band assembly 77 to be stowed inside the graphics tube 22 when not in use, and has an additional advantage of accommodating varying sizes of graphics tubes 22, if desired.

Referring to FIG. 11, the scribing implement assembly 26 comprises a second set nut 73, a second end portion 74, a second lock nut 75, a second saddle 76, a second flex-band assembly 77, a scribing or marking implement chuck 78 and a scribing or marking implement 79. The scribing implement assembly 26 in the present instance is constructed generally similarly to the pivot pin assembly 25, except that the scribing implement assembly 26 normally has a scribing implement chuck 78 which is adapted to hold a scribing or marking implement 79, generally comprising pencil lead, a pen implement or a caliper point.

The scribing implement assembly 26 has a second aperture 80 formed by flexible and resilient walls 81. The scribing implement assembly 26 is adapted to stow, seat or fit within the second end 32 of the graphics tube 22 when the instrument 20 is configured as shown in FIG. 1. The scribing implement assembly 26 may be removed from the second end 32 of the graphics tube 22, the graphics tube 22 removed from the tubular body 21, and the graphics tube 22 may be inserted into the second aperture 80 and the scribing instrument assembly 26 "locked" in place to form a compass or caliper assembly as shown in FIG. 12. As will be apparent to those skilled in the art, the scribing implement assembly 26, when fixed to the graphics tube 22 along with the pivot pin assembly 25, may be used to scribe circles around the pin point 66. It will be understood that the scribing implement 79 may be replaced by a pin point and the instrument illustrated in FIG. 12 may be used as a caliper or as a divider.

It is desirable when scribing or drawing circles or large arcs, that the draftsman need not change his grip upon the instrument. Additionally, a draftsman may be able to draw a circle with one hand. This reduces the chance of dropping the instrument. This feature is achieved in the disclosed embodiment by making the first raised knob 35 rotatable, and by making the second raised knob 36 also rotatable. The simultaneously rotatable knobs 35 and 36 permit circles or relatively large arcs to be drawn with ease and without adjusting one's grip upon the second knob 36 or the first knob 35. In a presently preferred embodiment, the first raised knob 35 and the first end portion 61 are formed into a one-piece configuration. The first raised knob 35 forms a conveniently grasped handle upon the first end portion 61, and both are constructed such that rotation of the first knob 35 about the axis of the pivot pin assembly 25 is freely permitted, yet radial movement of the first knob 35 with respect to the graphics tube 22 as shown in FIG. 12 is generally inhibited. The second raised knob 36 and second end portion 74 are preferably similarly constructed, except that in the illustrated embodiment, the second end portion 74 has a spacing member 84 formed thereon between the second lock nut 75 and the second end portion 74. In use, the first lock nut 62 may be tightened upon the first threaded post 69 in order to tighten the first saddle 63 against the face 30 of the graphics tube 22 and thus inhibit the pivot pin assembly 25 from sliding or rotating upon the graphics tube 22. Similarly, the second lock nut 75 may be tightened down upon the second threaded post 82 in order to tighten the second saddle 76 into secure engagement with the face 30 of the graphics tube 22, thus locking it into place. In practice, the second lock nut 75 is typically loosened to permit the scribing implement assembly 26 to slide to the desired position upon the graphics tube 22 and then the second lock nut 75 is tightened down upon the second saddle 76 to inhibit the scribing implement assembly 26 from sliding away or rotating from the desired setting. This feature improves the accuracy of the arcs or curves sought to be scribed. This feature also maintains the distance between the pin point 66 and the scribing implement 79 (or a pin point substituted therefore when the instrument is used as a caliper).

In a preferred embodiment, at least one of the walls 68 of the first flex-band assembly 64 should be transparent to permit the scales 33 upon the face 30 of the graphics tube 22 to be viewed. The wall 68 preferably has a first compass hairline means 85 thereon which permits accurate alignment of the pivot pin assembly 25 upon the scales 33 of the graphics 22. It will be appreciated that the first compass hairline means 85 preferably is in corresponding relationship to, or correct calibration with, the pin point 66. Similarly, the walls 81 of the scribing implement assembly 26 are preferably transparent having a second compass hairline means 86 thereon. In operation, the first compass hairline means 85 may be aligned in correspondence with the initial or zero graduations 38 upon the scales 33 and the second compass hairline means 86 may be then used to measure the distance upon the scales 33 between the pin point 66 and the scribing implement 79, or alternatively the second compass hairline means 86 may be placed into corresponding position upon the desired graduation upon the scales 33, that is, it may be set any desired distance on the scales 33.

The instrument 20 may also be used as a protractor. From any fixed point from which an angle is to be formed by two lines, a line one foot long may be drawn along one side, preferably utilizing the straightedge magnifier 24, to form the base of the angle. The hairline means 37 may be set a known distance on this line away from the vertex of the angle to be measured. The instrument 20 is then rotated ninety degrees until it is perpendicular to the baseline previously drawn. The angle may then be read upon an appropriately calibrated scale 33. The proper scale 33 may be selected by rotating the graphics tube 22, and the reading may be taken by sliding the cursor 23 to intersect with the other leg of the angle, and reading the scale to give the angle in degrees, or other desired units.

It is sometimes desirable to be able to flip back and forth quickly between two scales. For example, the drafting instrument described herein may be employed as a proportional divider by using two scales 33 on the graphics tube 22 which are scaled in the same proportion with respect to each other as the proportion by which the proportional division is desired. Those familiar with proportional dividers and drafting procedures related thereto will readily appreciate that the instrument disclosed herein may be used as a proportional divider by flipping back and forth between two desired scales 33.

Figure 13:
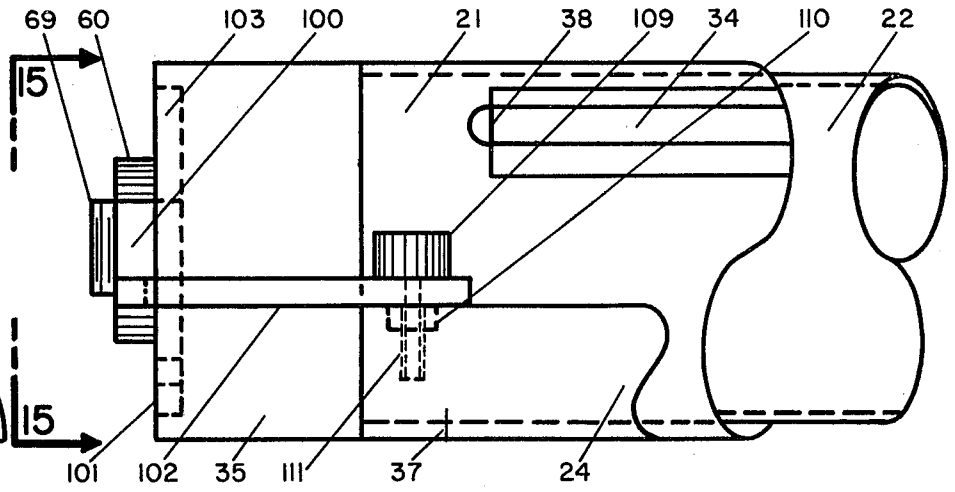
FIG. 13 shows an elevation view of an end of the tubular body and graphics tube illustrating the adjustable stop mechanism.
Figure 14:
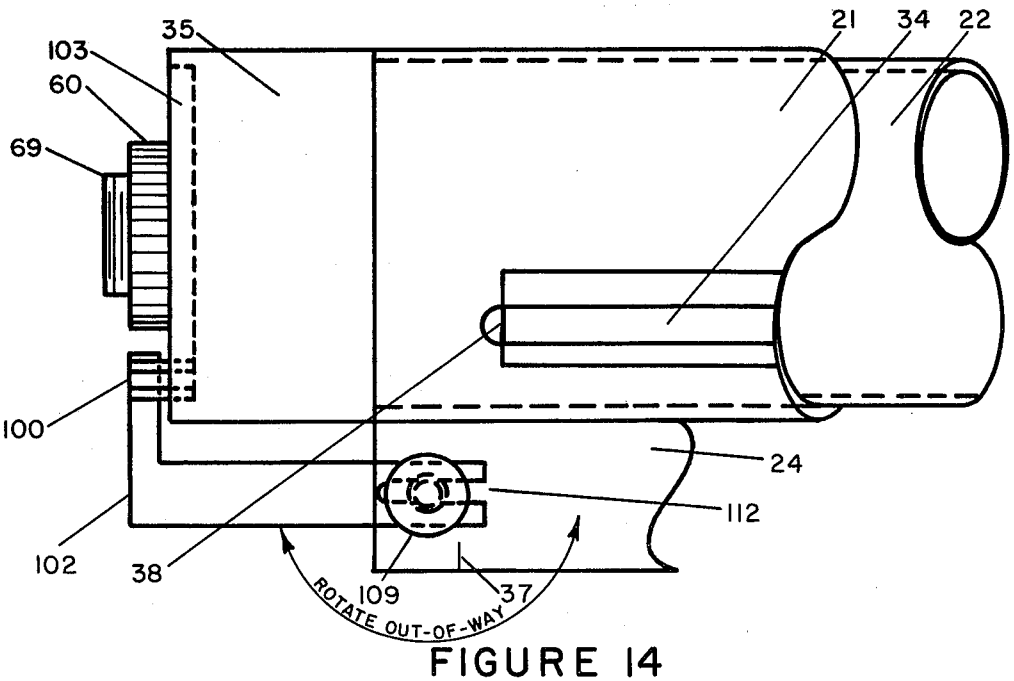
FIG. 14 is a top view of the adjustable stop mechanism.
Figure 15:
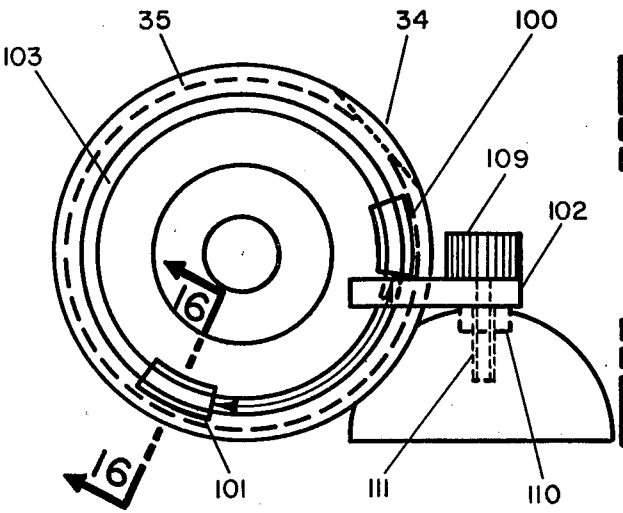
FIG. 15 is an end view of the adjustable stop mechanism illustrated in FIG. 13.

The use of the disclosed instrument as a proportional divider is greatly facilitated by a first and second adjustable stop 100 and 101, and a fixed stop 102, as shown in FIGS. 13, 14, 15 and 16. As best shown in FIG. 15, a stop groove 103 is formed upon the knob 35. When the adjustable stops 100 and 101 are placed within the stop groove 103, the graphics tube 22 may be readily rotated within the tubular body 21 to a specific desired scale 33 because the adjustable stop 100 or 101 will contact the fixed stop 102 and inhibit further rotation of the graphics tube 22. When the adjustable stop 100 is in contact with the fixed stop 102, the desired scale 33 will be in alignment with the viewing slot 34. Similarly, when the second adjustable stop 101 is brought into contact with the fixed stop 102, the second desired scale 33 will be brought into corresponding alignment with the viewing slot 34. Thus, the graphics tube 22 may be readily rotated back and forth between two desired scales to facilitate operation of the instrument as a proportional divider. This will also facilitate conversion between two scales, for example, metric to English, or vice-versa.

Figure 16:
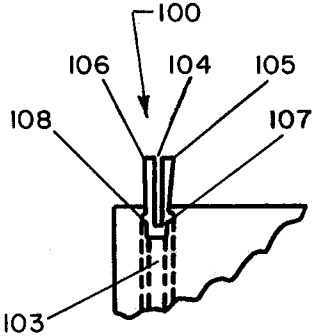
FIG. 16 is a cross-sectional view of an adjustable stop.

Turning now to FIG. 16, the adjustable stop 100 is preferably formed in a V-shape. A space 104 between legs 105 and 106 of the stop 100 permit the legs 105 and 106 to be squeezed together to facilitate removal of the stop 100 from the stop groove 103. The adjustable stops 100 and 101 are preferably fashioned from flexible material, and plastic has given satisfactory results in practice. The stop 100 may have cleats 107 and 108 to hold the stop 100 securely in place when it is inserted into the stop groove 103. It will be appreciated that the second adjustable stop 101 is constructed similarly to the first adjustable stop 100.

Referring to FIG. 13, it will be seen that the fixed stop 102 is fastened to one end of the straightedge magnifier 24 by means of a set screw 109 and a washer 110 which fits within a tapped hole 111. The set screw 109 may be securely screwed into the tapped hole 111 to hold the fixed stop 102 into position.

As best shown in FIG. 14, the fixed stop 102 is preferably L-shaped. The fixed stop 102 has a notch 112 cut in one end to permit the fixed stop 102 to be inserted between the head of the set screw 109 and the straightedge magnifier 24. If desired, the set screw 109 may be loosened to permit the fixed stop 102 to be rotated counterclockwise as shown in FIG. 14. This rotation will disable the adjustable stop mechanism so that the graphics tube 22 may once again be rotated freely without removing the adjustable stops 100 and 101.

In the illustrated embodiment, the adjustable stop assembly comprising the adjustable stops 100 and 101, the stop groove 103, the set screw 109, the washer 110, the tapped hole 111 and the fix stop 102, are shown in connection with the left knob 35. It will be appreciated that the adjustable stop assembly may be used in conjunction with the right knob if desired.

Those skilled in the art of drafting will appreciate that the adjustable stop assembly greatly facilitates the changing of the scales of a drawing because the graphics tube 22 may be rotated between stop locations quickly, without necessitating any need to hunt for the correct scale 33 or carefully align the desired scale 33 with the viewing slot 34.

For example, to reduce a drawing by a ratio of 6:1, a draftsman could rotate the graphics tube 22 until a "10 scale" 33 appears through the viewing slot 34. The draftsman may then set the first adjustable stop 100 and stop groove 103 flush against the fixed stop 102. The draftsman would then rotate away from the now set first adjustable stop 100, until a "60 scale" 33, for example, was aligned with the viewing slot 34. The second adjustable stop 101 could then be set on the opposite side of the fixed stop 102 from which the first adjustable stop 100 was set. Once these stops are set, the draftsman could easily rotate back to the "10 scale" 33 and measure any desired dimension. By flipping back to the "60 scale" 33, as the graphics tube 22 automatically stops there when the second stop 101 contacts the fixed stop 102, the draftsman could then scale off the amount measured on the "10 scale" 33.

This rapid flipping back and forth between scales allows the draftsman to immediately view the corresponding desired scale 33 only an instant after viewing the first scale 33, and permits him to do so while still retaining a mental image of the first reading. In addition to other advantages, the selection of an appropriate reduction ratio between scales 33 may be facilitated because of the ability to more easily develop a mental impression of the reduction ratio between the scales 33.

It will be appreciated that the adjustable stop mechanism has a utility in addition to the use of the instrument as a proportional divider. For example, when making conversions, a draftsman could adjust the stops 100 and 101 so that he could flip back and forth between a metric and an English scale 33. Other uses and advantages of the adjustable stop mechanism will readily appear to those skilled in the art.

In FIG. 12, the graphics tube 22 is shown broken to indicate that the graphics tube 22 may be any desired length. In practice, a length of approximately 13 inches has given satisfactory results. Several graphics tubes 22 of varying lengths may be used in conjunction with the instrument 20. Generally, the tubular body 21 has a matching length or is substantially the same length as the graphics tube 22, but both the tubular body 21 and the graphics tube 22 may be designed to have extensions attached thereto.

It will be appreciated that the first end portion 61 and the first raised knob 35 may be removed from the remainder of the pivot pin assembly 25 as shown in FIG. 6. If removed, the first end portion 61 and the first raised knob 35 may be used to hold the graphics tube 22 within the outer tubular body 21 in the configuration of the instrument 20 illustrated in FIG. 1. However, the pivot pin assembly 25 is adapted to nest or stow within the graphics tube 22 and can thus be conveniently placed out of the way, yet maintained in an easily accessible position which does not require the draftsman to search for the pivot pin assembly 25 when he desires to use it. Similarly, the second end portion 74, the spacing member 84 and the second raised knob 36 may be removed from the remainder of the scribing implement assembly 26 and used independently in connection with the configuration of the instrument 20 illustrated in FIG. 1, but the scribing implement assembly 26 is normally placed in the convenient storage provided by the graphics tube 22.

Appropriate scales 33 may be placed upon the face 30 of the graphics tube 22 which are calibrated to give a direct reading, in correspondence with the second compass hairline means 86, of the area or circumference of a circle having a diameter or radius (r) equal to the distance between the pin point 66 and the scribing implement 79. The scales 33 could be constructed in accordance with the relationship that the area of a circle is equal to pi times $r^2$. The scales 33 may also be constructed in accordance with the relationship that the circumference of a circle equals 2 pi times r. In both cases, r could be the distance between the pin point 66 and the scribing implement 79. The scales 33 may be stated in terms of the diameter (d) of a circle in accordance with the relationship: $d=2r$. Similarly, appropriate scales could be provided to give the area or volume of other geometric shapes.

In addition, conversion tables, important constants, and other useful information may be inscribed upon the outer surface 28 of the tubular body 21, or upon additional interchangeable graphics tubes 22.

In a presently preferred embodiment, all scales 33 have a common zero point, or an initial graduation 38, as shown in FIG. 4 and in FIG. 18, including the architectural scales. This is believed to be a novel feature of the invention, in that the zero point of conventional architectural scales are not aligned, in order to allow for an additional increment to show the "inch" graduations. In a preferred embodiment of the instrument 20, the inch markings extend throughout the entire length of each architectural scale 33 allowing for a common zero point 38.

It will be apparent that the graphics tube 22 may be rotated within the first and second apertures 67 and 80 in order to bring any desired scale 33 upon the face 30 of the graphics tube 22 into corresponding alignment with the first and second compass hairline means 85 and 86.

SUMMARY OF ADVANTAGES OF THE INVENTION

It will be appreciated that in constructing a drafting instrument according to the present invention, certain significant advantages are provided.

In particular, a combination drafting instrument is provided which eliminates the need for numerous separate instruments in order to perform various drafting procedures. This feature of the present invention offers the significant advantage of eliminating the delay and consequent tedium and frustration caused when a draftsman is required to search around the working area for an appropriate instrument. The present invention may eliminate the need for a separate architect's scale, engineer's scale, beam compass, magnifier, protractor, proportional divider, separate "80" scale, conversion tables, and calipers. Because a single instrument performs the functions of many of the numerous instruments previously required, the number of physical motions normally required for some drafting procedures, including searching for the correct instrument, may be eliminated or minimized. Graphics tubes may be interchangeable to permit the use of an unlimited number of scales. A plurality of scales are provided in a single instrument.

An instrument constructed according to the present invention should provide significant economies in construction and may be manufactured more easily and inexpensively than the numerous separate instruments that it may replace.

The drafting instrument disclosed provides the advantage of reducing eye strain by displaying only a single scale at a time when the graphics tube is inserted into the outer tubular body and which reduces the level of concentration required on the part of the draftsman if he looks down from the instrument onto the working surface and then looks back up again to attempt to locate a desired position upon the displayed scale. The provision of fixed and adjustable stops allows use as a proportional divider with a quick and precise rotation of the scales. The hairline on the cursor also serves to mark or record the location of a reading on a scale when looking away or changing scales. The straight-edge magnifier disclosed reduces eye strain by magnifying the important portion of a drawing or the working surface immediately adjacent to the outer tubular body. The fixed hairline register means upon the lower surface of the straightedge magnifier reduces eye strain by providing a convenient hairline in alignment with initial graduations on the scales to facilitate accurate alignment of the instrument upon the working surface. The upper hairline means and lower hairline means on the cursor assembly provides the advantage of reducing eye strain by providing an accurate indication directly upon the working surface of a point which corresponds with the position of the upper hairline means upon the displayed scale on the graphics tube.

All scales have a common zero, including architectural scales, facilitating ease of operation of the conveniently rotatable graphics tube by maintaining a common reference or initial point on each scale when the graphics tube is rotated, and also simplifying the reading of the architectural scales. All scales are read on the same side of the instrument without the necessity of turning it over or around to find the needed scale, as in prior art devices.

The ease of quickly running through a large number of scales provides the advantage of being able to easily and quickly determine the scale of a drawing. The advantage of a means of measuring angles with a linear scale, thus eliminating the separate bulky protractor instrument normally required, is provided by this present invention.

Ease of operation is provided by the present invention. The set screw on the cursor assembly permits the resistance of the cursor assembly to slide up and down the tubular body to be adjusted as desired.

The first and second saddles may be easily adjusted securely against the face of the graphics tube by the first and second lock nuts respectively.

The present invention provides the advantage of permitting substitution of a practically unlimited number of graphics tubes in order to permit the utilization of a wide range of scales upon the face of the graphics tube as desired. Easy conversion to metric or S.I. units of measurement may be accomplished. The present invention provides the advantage of being adaptable to any desired length and is operable with various sized graphics tubes and corresponding tubular bodies, cursors, pin and scribing implement assemblies.

In use as a compass, the instrument has several advantages. The scribing implement assembly and pivot pin assembly conveniently stow inside the graphics tube when the instrument is in use as a scale. The scribing implement assembly and pivot pin assembly are easily removed from their stowed position and set the desired distance apart on any scale on the graphics tube. The freely turning knobs on both the pin and scribing assemblies make the scribing of circles or arcs easy and confortable. Because readings may be taken directly from the graphics tube, a separate measuring device or scale to adjust or set the compass or calipers is not required.

The significant advantages of simplicity and versatility are also provided by the present invention. The present invention is easily constructed and may perform numerous functions previously performed by numerous separate instruments. The present invention has the virtue of simplicity while maintaining accuracy. Drafting procedures may be accomplished more quickly and easily than may be accomplished with conventional drafting instruments because delays introduced by the requirement of searching for separate conventional instruments are avoided.

The foregoing description of the invention has been directed to a particular preferred embodiment in accordance with the requirements of the patent statutes and for purposes of explanation and illustration. It will be apparent, however, to those skilled in the art that modifications and changes in the instrument may be made without departing from the scope and spirit of the invention. For example, equivalent elements or materials may be substituted for those illustrated and described herein, parts may be reversed, and certain features of the invention may be utilized independently of the use of other features, all as would be apparent to one skilled in the art after having the benefit of this description of the invention. Accordingly, this description is to be construed as illustrative only and is for the purpose of teaching those skilled in the art the manner of carrying out the invention. It is intended that all alternatives, modifications and variations which fall within the spirit and scope of the invention as defined in the appended claims be embraced thereby.

What is claimed is:

1. A drafting instrument comprising:

an outer tubular body, said tubular body having a longitudinal axis, said tubular body having inner and outer surfaces, said tubular body having an axially elongated viewing slot communicating between said inner and outer surfaces, said tubular body having a bore extending longitudinally therethrough, said bore being adapted to receive a graphics tube, said tubular body having a guide groove extending longitudinally along said outer surface;

a graphics tube, said graphics tube being adapted to fit within said bore, said graphics tube having a face, said graphics tube having scales on the face of said graphics tube, any of said scales being viewable through said viewing slot when said graphics tube is rotated to bring the corresponding face of said graphics tube into alignment with said viewing slot, said graphics tube having a first end and a second end;

a straightedge magnifier, said magnifier being connected to said outer surface of said tubular body, said magnifier being adapted to magnify images on a working surface, said magnifier having a straightedge extending substantially parallel with the longitudinal axis of said tubular body, said straightedge being adapted to guide a marking implement in a substantially straight line upon a working surface, said straightedge magnifier having a fixed hairline register means, said register means being aligned with initial graduations upon said scales;

a cursor assembly, said cursor assembly being adaptable to slideably register upon said outer surface of said tubular body, said cursor assembly having a guide shoe, said guide shoe being adapted to register within said guide groove along said outer surface of said tubular body, said cursor assembly having an upper hairline means and a lower hairline means, said upper hairline means being alignable with a graduation upon said scales through said viewing slot, said lower hairline means being alignable upon a working surface, said cursor assembly being adapted to slide longitudinally along said outer surface of said tubular body;

a pivot pin assembly, said pivot pin assembly being securely seatable within the first end of said graphics tube, said pivot pin assembly having a first end portion, said first end portion having a first raised knob adapted to inhibit longitudinal movement of said graphics tube within said tubular body while permitting said graphics tube to be axially rotated within said tubular body when said pivot pin assembly is seated upon the first end of said graphics tube, said pivot pin assembly having a first aperature adapted to receive said graphics tube, said graphics tube being insertable within said first aperature, said pivot pin assembly having a pin point, said pivot pin assembly having first compass hairline means alignable with the graduations of said scales upon the face of said graphics tube;

a scribing implement assembly, said scribing implement assembly being securely seatable within the second end of said graphics tube, said scribing implement assembly having a second end portion, said second end portion having a second raised knob adapted to inhibit longitudinal movement of said graphics tube within said tubular body while permitting said graphics tube to be axially rotated within said tubular body when said scribing implement assembly is seated upon the second end of said graphics tube, said scribing implement assembly having a second aperture adapted to slideably receive said graphics tube, said graphics tube being insertable within said second aperature, said scribing implement assembly being adapted to hold a scribing implement, said scribing implement assembly having second compass hairline means alignable with the graduations of said scales upon the face of said graphics tube, said scribing implement assembly being adapted to slide longitudinally upon said graphics tube when said graphics tube is inserted into said second aperature, said scribing implement assembly being adaptable for scribing circular arcs around said pin point when said graphics tube is inserted into said aperatures of said scribing implement assembly and said pivot pin assembly;

said tubular body, said graphics tube, said straightedge magnifier, said cursor assembly, said pivot pin assembly and said scribing implement assembly being mutually cooperable to provide a plurality of rotatable scales viewable one at a time through a viewing window, and to provide hairline means which may be aligned simultaneously upon the viewable scale and a working surface while a corresponding image upon the working surface is magnified, said pivot pin assembly and said scribing implement assembly being cooperable to permit rotation of said graphics tube within said tubular body while inhibiting substantial longitudinal movement of said graphics tube with respect to said tubular body when said pivot pin assembly and said scribing implement assembly are inserted into the first and second ends of said graphics tube while said graphics tube is inserted into the bore of said tubular body; and, said graphics tube, said pivot pin assembly and said scribing implement assembly being mutually cooperable to comprise a multiple-scale compass when said graphics tube is removed from said tubular body and inserted into said first aperature in said pivot pin assembly and said second aperature in said scribing implement assembly, said pivot pin assembly and said scribing implement assembly providing first and second compass hairline means to permit readings to be taken from said scales on the face of said graphics tube.

2. The instrument according to claim 1, wherein said pivot pin assembly further comprises a first flex-band assembly and wherein said first aperature is formed within said first flex-band assembly, said first flex-band assembly being resilient and being adapted to fit within said graphics tube while permitting sufficient expansion to allow said graphics tube to be inserted into said first aperature.

3. The instrument according to claim 1 or claim 2, wherein said scribing implement assembly further comprises a second flex-band assembly and wherein said second aperature is formed within said second flex-band assembly, said second flex-band assembly being resilient and being adapted to fit within said graphics tube while permitting sufficient expansion to allow said graphics tube to be inserted into said second aperature.

4. The instrument according to claim 1, wherein said viewing slot is adapted to permit only one of said scales on the face of said graphics tube to be viewable at a time.

5. The instrument according to claim 4, wherein said graphics tube has a plurality of architectural scales and engineering scales upon said face of said graphics tube.

6. The instrument according to claim 1, claim 2 or claim 4, wherein said first raised knob is rotatable upon a first axis substantially perpendicular to the longitudinal axis of said graphics tube, and wherein said second raised knob is rotatable upon a second axis substantially perpendicular to the longitudinal axis of said graphics tube, said second axis being remote from said first axis.

7. A drafting instrument comprising:

an outer tubular body, said tubular body having a longitudinal axis, said tubular body having inner and outer surfaces, said tubular body having an axially elongated viewing slot communicating between said inner and outer surfaces, said tubular body having a bore extending longitudinally therethrough, said bore being adapted to receive a graphics tube, said tubular body having a guide groove extending longitudinally along said outer surface;

a graphics tube, said graphic tube being adapted to fit within said bore, said graphics tube having a face, said graphics tube having scales on the face of said graphics tube, said scales being viewable through said viewing slot when said graphics tube is rotated to bring the corresponding face of said graphics tube into alignment with said viewing slot, said graphics tube having a first end and a second end;

a straightedge magnifier, said magnifier being connected to said outer surface of said tubular body, said magnifier being adapted to magnify images on a working surface, said magnifier having a straightedge extending substantially parallel with the longitudinal axis of said tubular body, said straightedge being adapted to guide a marking implement in a substantially straight line upon a working surface, said straightedge magnifier having a fixed hairline register means, said register means being aligned with initial graduations upon said scales;

a cursor assembly, said cursor assembly being adaptable to slideably register upon said outer surface of said tubular body, said cursor assembly having a guide shoe, said guide shoe being adapted to register within said guide groove along said outer surface of said tubular body, said cursor assembly having an upper hairline means and a lower hairline means, said upper hairline means being alignable with a graduation upon said scales through said viewing slot, said lower hairline means being alignable upon a working surface, said cursor assembly being adapted to slide longitudinally along said outer surface of said tubular body;

a first raised knob, said first raised knob being adapted to fit within the first end of said graphics tube;

a second raised knob, said second raised knob being adapted to fit within the second end of said graphics tube; and, said tubular body, said graphics tube, said straightedge magnifier, said cursor assembly, said first raised knob and said second raised knob being mutually cooperable to provide a plurality of rotatable scales viewable one at a time through a viewing window, and to provide hairline means which may be aligned simultaneously upon the viewable scale and a working surface while a corresponding image upon the working surface is magnified, said first raised knob and said second raised knob being cooperable to permit rotation of said graphics tube within said tubular body while inhibiting substantial longitudinal movement of said graphics tube with respect to said tubular body when said first raised knob and said second raised knob are inserted into the first and second ends of said graphics tube while said graphics tube is inserted into the bore of said tubular body.

* * * * *